United States Patent [19]

Kobayashi

[11] 4,080,973

[45] Mar. 28, 1978

[54] APPARATUS FOR PAYING OUT COINS OF CHANGE

[75] Inventor: Osamu Kobayashi, Sakadomachi, Japan

[73] Assignee: K.K. Nippon Coinco, Tokyo, Japan

[21] Appl. No.: 778,990

[22] Filed: Mar. 18, 1977

[30] Foreign Application Priority Data

Mar. 25, 1976 Japan ..... 51-36008

[51] Int. Cl.[2] ..... G07D 1/02

[52] U.S. Cl. ..... 133/5 R

[58] Field of Search ..... 194/10; 133/4 A, 4 R, 133/5 R; 221/124, 129

[56] References Cited

U.S. PATENT DOCUMENTS 3,080,035 3/1963 Diaz ..... 133/4 R

*Primary Examiner*—Stanley H. Tollberg

*Attorney, Agent, or Firm*—Koda and Androlia

[57] ABSTRACT

Apparatus for paying out change coins comprises a frame, a motor, a disc driven by the motor, a movable member moved by the motor, a plurality of operating plates slidably disposed within the movable member, pins located within the movable member and projected therefrom in response to the movement of the corresponding one of the operating plates, a plurality of coin pay-out plates each located to freely engage with the corresponding one of the pins, a plurality of coin holding cylinders for feeding coins therefrom one by one on the corresponding coin pay-out plates, and controlling mechanism operatively connected to the movable member. The controlling mechanism includes working rods having projections which selectively engage or release one of operating plates thereby moving the corresponding one coin pay-out plate.

5 Claims, 17 Drawing Figures

28
27

33
33
28
27

33
28
33
27

33
33
27
28

33
33
27
28

33
33
27
28
33
33

APPARATUS FOR PAYING OUT COINS OF CHANGE

BACKGROUND OF THE INVENTION

This invention relates to an apparatus for paying out coins of the change one by one from a plurality of coin holding cylinders.

Generally, an apparatus combined with an automatic vending machine for paying out change coins includes a plurality of cylinders for holding a number of coins, coins in the cylinders are paid out one by one from each of coin holding cylinders through a coin pay-out plate. In a conventional coin pay-out apparatus in which when change coins are paid out one by one from the coin holding cylinders, all coin pay-out plates begin to operate with a small time difference. Accordingly, the conventional apparatus has needed a large power for operating all coin pay-out plates at once, which is an important defect for this apparatus.

SUMMARY OF THE INVENTION

Accordingly, a principle object of this invention is to provide an improved apparatus for paying out change coins one by one.

Another object of this invention is to provide a coin pay-out apparatus including a controlling mechanism for rendering plurality of operating plates to operate selectively to pay out change coins one by one.

A further object of this invention is to provide a coin pay-out apparatus including an improved coin pay-out plate which has unique configulation that can assure stable pay-out condition of the change coins.

According to this invention there is provided an improved apparatus for paying out coins of the change. The apparatus comprises a frame, a motor, a disc driven by the motor, a movable member moved by the motor, a plurality of operating plates slidably disposed within the movable member, pins located within the movable member and projected therefrom in response to the movement of the corresponding one of the operating plates, a plurality of coin pay-out plates each located freely engageable with the corresponding one of the pins, a plurality of coin holding cylinders for feeding coins therefrom one by one on the corresponding coin pay-out plates, and a controlling mechanism operatively connected to the movable member. When the movable member is moved the operating plates are also moved selectively one by one through the controlling mechanism and the pay-out plates are reciprocated by the movement of the respective operating plates thereby paying out of the coins of the change one by one.

BRIEF DESCRIPTION OF THE DRAWINGS

In the following, the invention will be explained in more detail with reference to the accompanying drawings, in which.

DESCRIPTION OF THE PREFERRED EMBODIMENT

Figure 1:
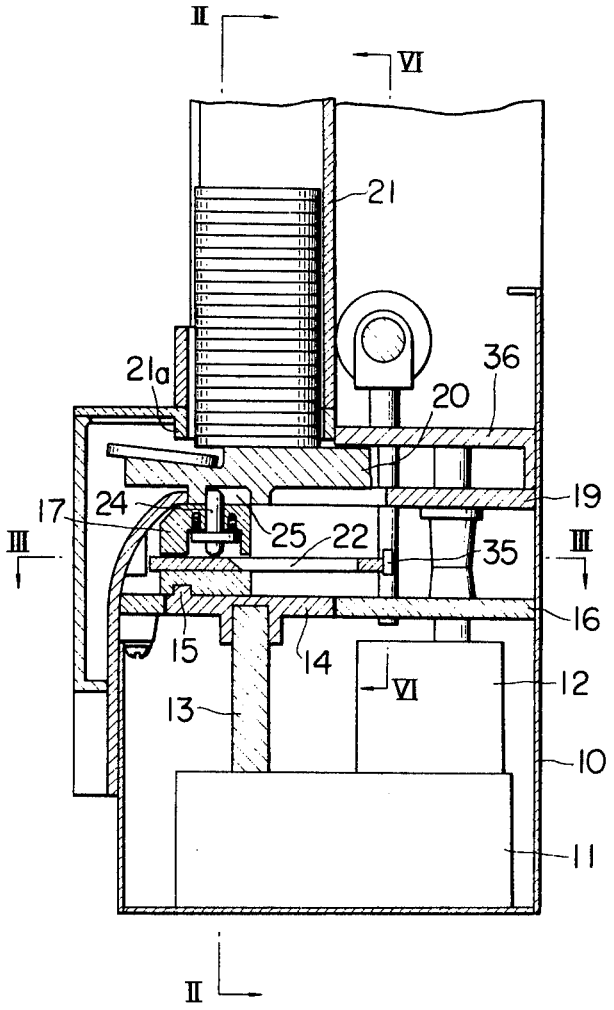
FIG. 1 shows a cross-sectional view of the apparatus for paying out change coins according to this invention.
Figure 2:
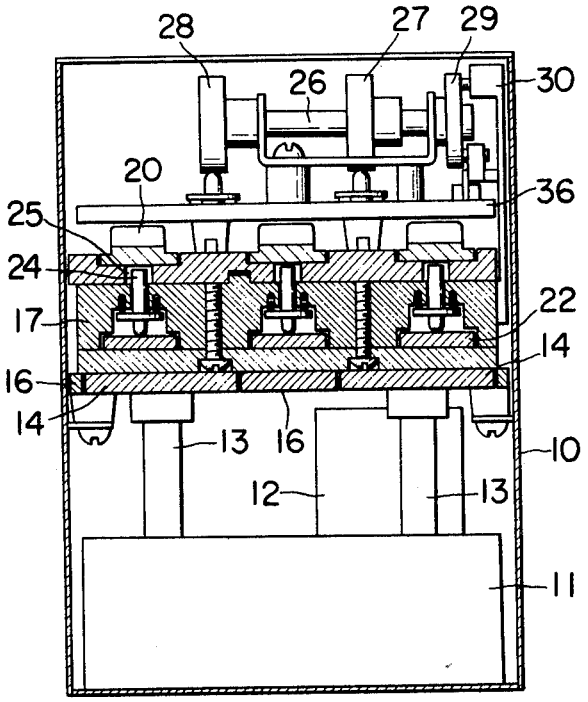
FIG. 2 shows a sectional view taken along the line II—II in FIG. 1.
Figure 3:
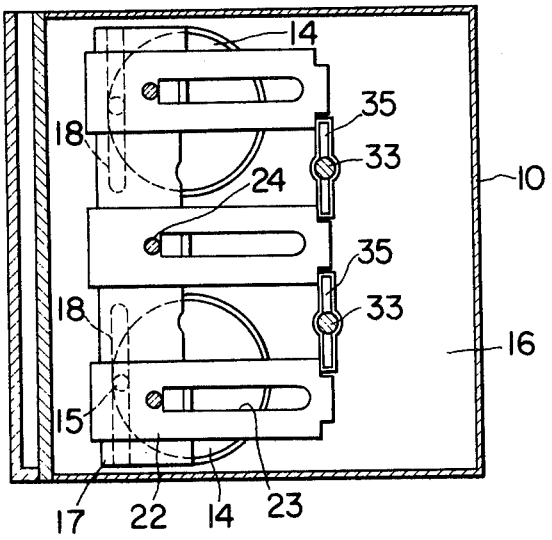
FIG. 3 shows a sectional view taken along the line III—III in FIG. 1.

Referring to the accompanying drawings, FIGS. 1 through 3 show one embodiment of the apparatus of this invention, in which a reduction gearing 11 is located at the bottom of a frame 10, a motor 12 is directly connected to the input shaft of the reduction gearing 11, and two circular discs 14 are directly connected to the output shafts of the reduction gear 11. On the upper surface of each disc 14 there are provided projecting pins 15 at the position apart from the axes of the output shafts. Each pin is slidably received in a groove 18 formed on the lower surface of a movable member 17 in a direction normal to the direction of movement of the movable member 17 which is linearly reciprocated along a guide plate 16 attached horizontally to and within the frame 10.

A guide plate 19 is located above the movable member 17 and attached to the frame in parallel relation to the guide plate 16, and to the upper surface of the guide plate 19 there are disposed a plurality of parallel coin pay-out plates 20 (three plates are shown in this embodiment) which are slidable in the same direction as the movable member 17 and spaced with each other. Over the guide plate 19 there is further disposed a supporting plate 36 to which a plurality of vertical coin holding cylinders are attached such that the lower opening of each cylinder is communicated with the corresponding portion of the coin pay-out plate 20.

In each of the coin holding cylinder many coins are stacked so as to pay out the lowermost coin in accordance with the movement of the pay-out plate 20.

Operating plates 22 operated by the movement of the corresponding pay-out plate 20 are disposed in the movable member 17, each operating plate 22 being movable in the same direction as of the movable member 17. On the central part of each of these plates 22 there is provided a longitudinal slit 23.

Within the movable member 17 movable pins 24 are suspended so as to fit in the slits 23 of the operating plates 22, respectively, and springs which urge the pins against the plate 22 are also incorporated. The upper end of each pin 24 is projected from the upper surface of the movable member 17 and to receive this projected end the pay-out plate 20 is provided with groove 25.

A controlling mechanism is disposed on the supporting plate 36 so as to successively move the coin pay-out plates 20.

Figure 4:
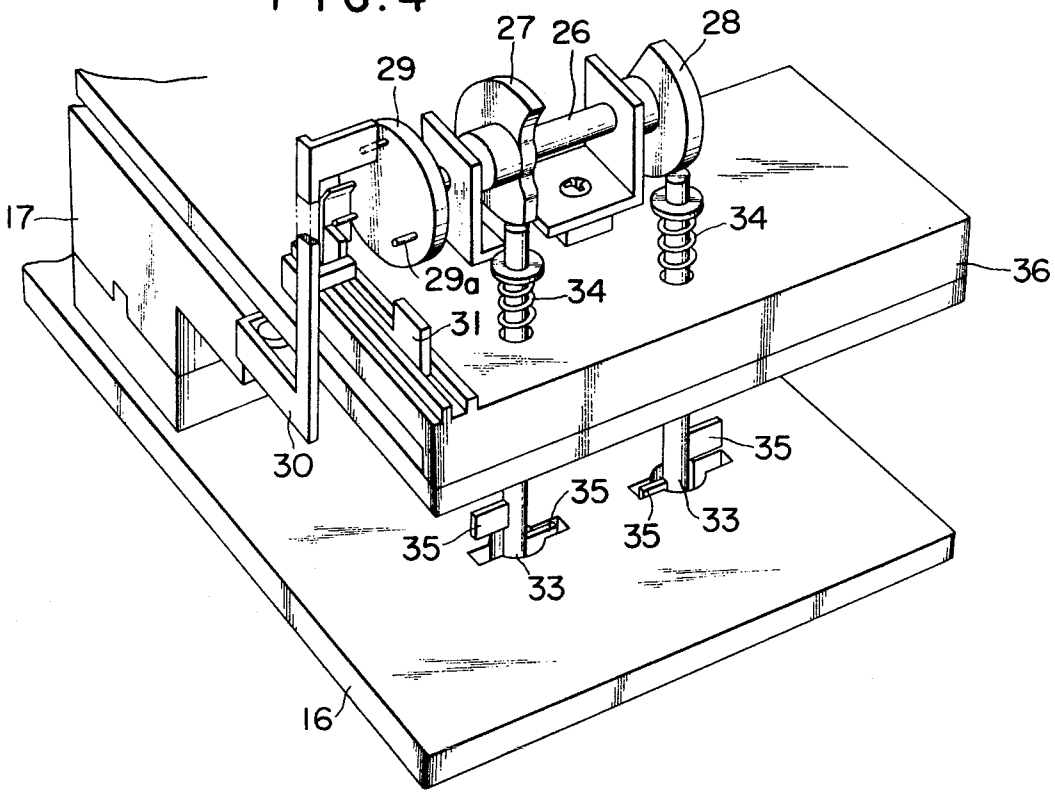
FIG. 4 shows a perspective view of a controlling mechanism of the apparatus according to this invention.
Figure 6:
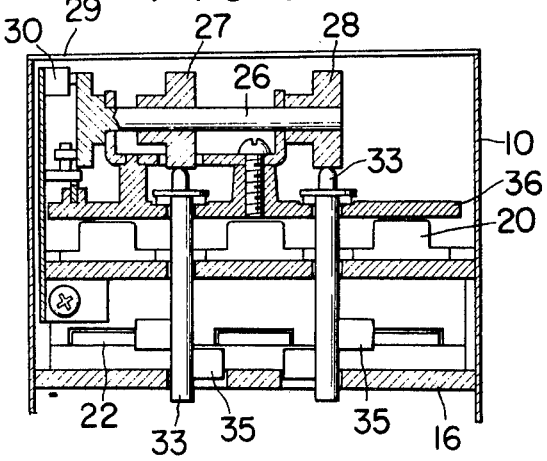
FIG. 6 shows a sectional view taken along the line VI—VI in FIG. 1.

FIG. 4 shows a controlling mechanism which comprises a plurality of cams 27 and 28 (only two are shown in this FIG. 4) fitted to a rotatary shaft 26 mounted on the supporting plate 36, a wheel 29 provided with 120° spaced pins **29*a*, for intermittently rotating the cams, a L-shaped lever 30 located on the side of the movable member 17 for rotating the wheel 29 by a predetermined angle, a sliding piece 31 reciprocated by the lever 30, and working rods 33 operated by the cams 27 and 28** respectively and adapted to release or engage the operating plates 22. The working rods 33 are resiliently biased by springs 34 so as to follow the movement of the cams 27 and 28 and provided with lateral projections 35 to engage the end portion of the operating plate 22. In this controlling mechanism, the cams are used for operating the working rods 33, but solenoids may also be used particularly, in a complicated mechanism.

The operation of this apparatus is as follows.

When the motor 12 is started, the rotatary shaft 13 is driven thereby through the reduction gearing 11, and by the rotation of the shaft 13 the movable member 17 is reciprocated on the guide plate 16. In accordance with this reciprocating movement of the member 17, the change coins are paid out one by one. This pay-out operation is described in detail hereinbelow.

Figure 5:
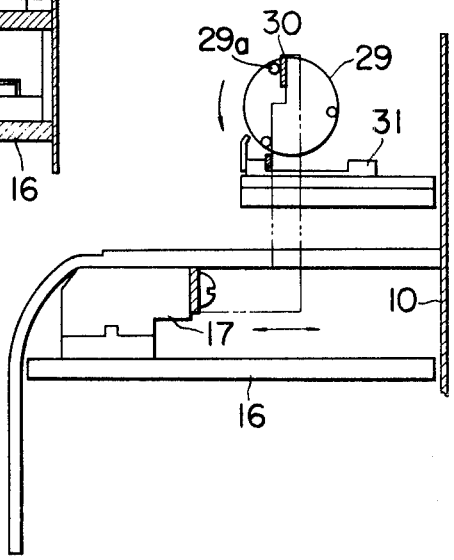
FIG. 5 shows an partial view useful to explain the operation of the controlling mechanism shown in FIG. 4.
Figure 8A:
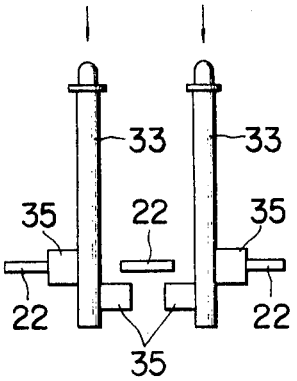
FIGS. 7*a* through 7*f* and FIGS. 8*a* through 8*c* are diagrammatic views for explaining a series of coin pay-out operations performed by the controlling mechanism of FIG. 4.
Figures 7A, 7B, 7C, 7D, 7E, 7F:
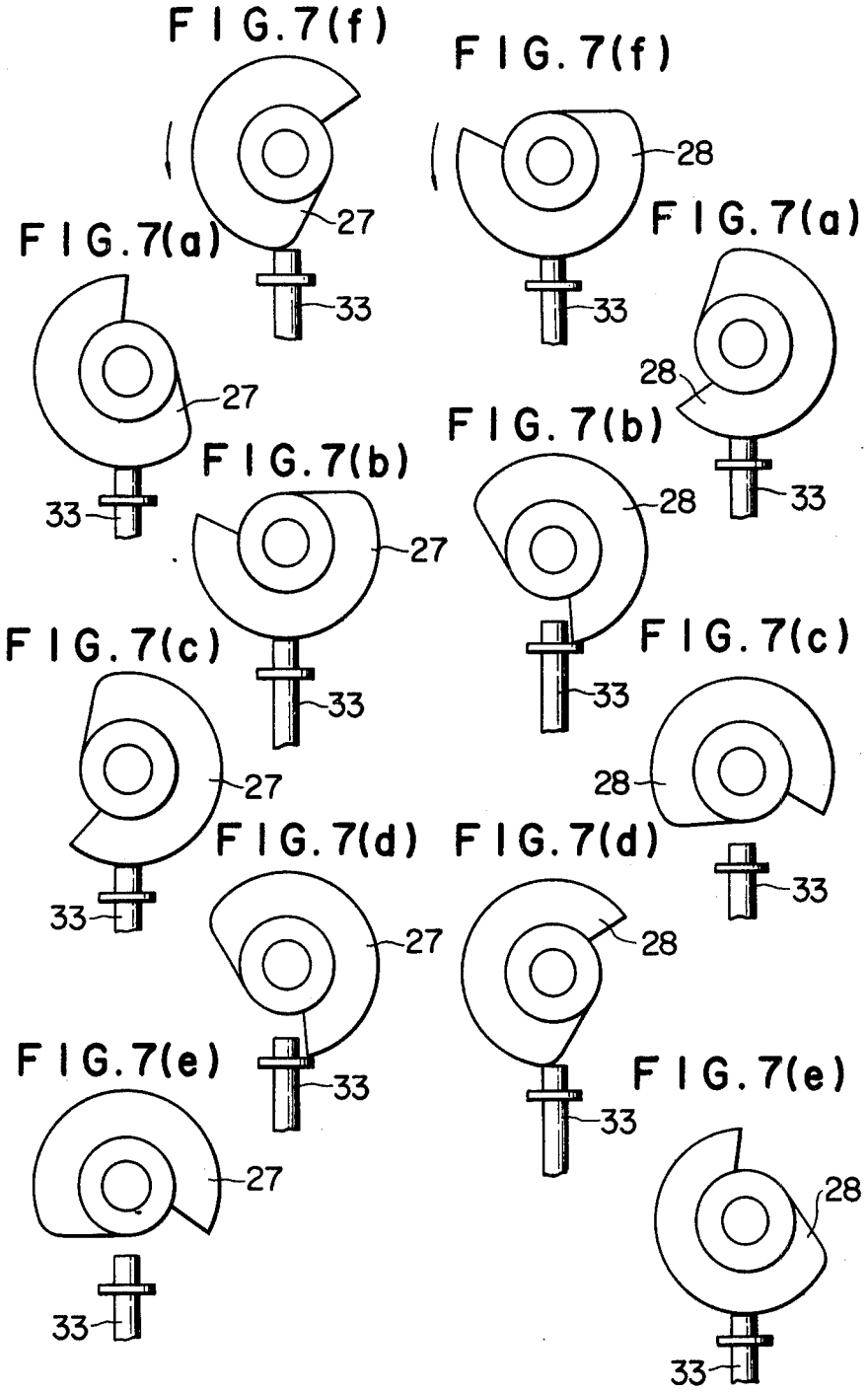
Figure 10:
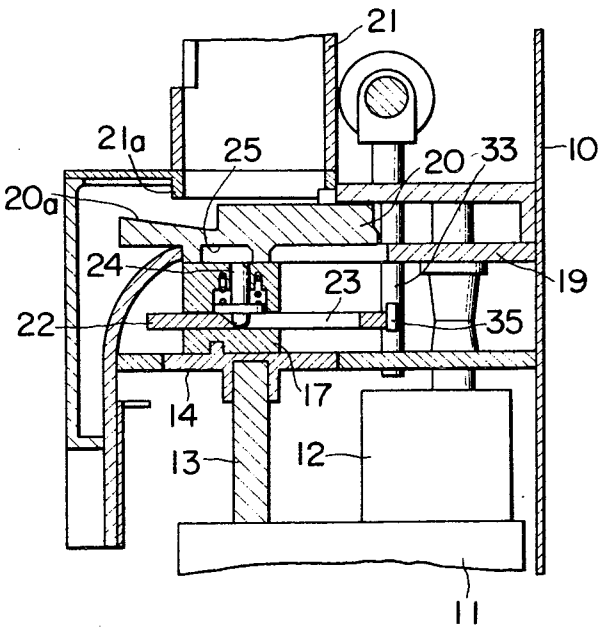
FIG. 10 is a vertical view showing another coin pay-out condition of the apparatus shown in FIG. 1.

In FIG. 5, when the movable member 17 is moved horizontally the lever 30 moves the sliding piece 31, for causing it to engage one of the pins 29*a* of the wheel 29 thus rotating the same by 60°. The rotation of the wheel 29 is transmitted to the cams 27 and 28. The cams, then, push continuously the working rods 33 respectively as shown in FIG. 7*a* and FIG. 8*a*. The projections 35 of the working rods which are in the condition shown in FIGS. 7*a* and 8*a* do not engage with the central operating plate 22 but with the other operating plates 22 thereby stopping the pay-out operation. The side operating plates 22 whose movements are stopped (shown in FIG. 10) are not moved even if the movable member 17 is moved because of the engagement with the projections 35 of the working rods 33. Therefore, the movable member 17 is slid with respect to the side operating plates 22 without moving therewith. In this condition, the pins 24 corresponding to the side plates 22 are fitted into the slits 23 of the plates 22 and the lower ends of the respective pins 24 are lowered below the lower surface of the member 17 and the pins disengage the grooves 25 thereby stopping the movement of the pay-out plates 20 corresponding to respective side operating plates 22. Thus, the pay-out of the change coins from these pay-out plates 20 is prevented.

Figure 8B:
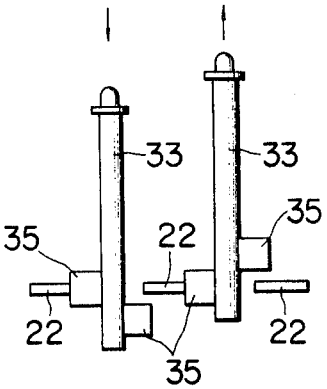
Figure 9:
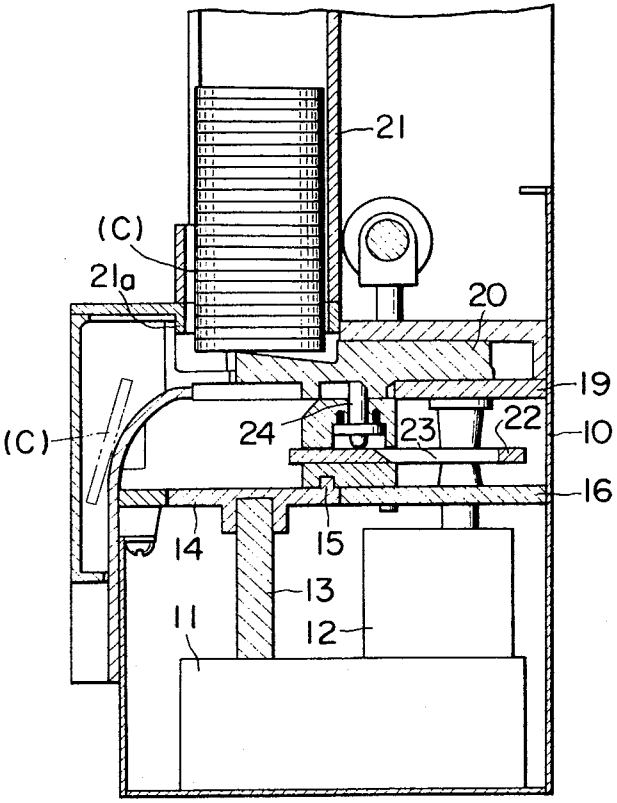
FIG. 9 is a vertical sectional view showing a coin pay-out condition of the apparatus shown in FIG. 1.

On the other hand, the central operating plate 22 which is not engaged with the projections 35 of the working rods 33 is moved with the movable member 17, and the pin 24 corresponding to the central plate 22 engages with the groove 25 of the corresponding pay-out plate 20. The pay-out plate 20 in this condition is moved to the right as viewed in FIG. 9 such that only one coin C mounted previously on the inwardly inclined surface 20*a* of the pay-out plate 20 falls down therefrom by contacting the lower end 21*a* of the coin holding cylinder 21. The succeeding return movement of the movable member 17 makes the pin of the wheel 29 to rotate further by 60° as shown in FIG. 5 by the operation of the lever 30 through the sliding piece 31. In this manner, the coin pay-out plate 20 corresponding to the central operating plate 22 is returned to the original position after the pay-out operation of the coin C. At this time, the cams 27 and 28 come to the positions shown in FIG. 7*b* and the right-most operating plate 22 takes the movable condition as shown in FIG. 8*b*. Regarding the right-most plate 22, the coin pay-out operation of the corresponding pay-out plate 20 can be performed by the same manner as mentioned with respect to the central operating plate 22. Thus, one coin on this pay-out plate 20 is paid out by the movement of the movable member 17.

Figure 8C:
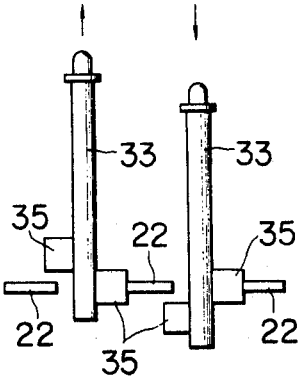

In the next stage, the cams 27 and 28 come to the positions shown in FIG. 7*d* by the return movement of the member 17 and then the left-most operating plate 22 takes the movable position as shown in FIG. 8*c*, and the coin pay-out operation can be achieved by the same manner as described above. After the last operation, the cams return to the original positions through the positions shown in FIGS. 7*e* and 7*f*.

As described above, by one reciprocating movement of the movable member 17, one coin can be paid out from one of the coin holding cylinders 21 by the backward movement (to the right) of the coin pay-out plate 20. When the plate is moved forwardly (to the left), the next coin in this cylinder 21 comes to the position on the pay-out plate 20 and takes the waiting condition for pay-out of coin. Such pay-out operation is repeated until all change coins are paid out.

The advantages of this invention are summerized as follows.

Since change coins are paid out one by one from a plurality of coin holding cylinders, the driving force of the motor can be reduced so that the motor with small capacity and small size can be used. Because of the unique configuration of the pay-out plate, the pay-out of each coin can be made stably and correctly from the same position.

There is described herein one preferred embodiment of apparatus for paying out the change coins, but the invention is not limited thereto and intended to cover other modifications and changes obvious to those skilled in the art without departing from the scope and spirit of the invention.

I claim:

1. Apparatus for paying out change coins one by one comprising a frame, a motor, a disc driven by said motor, a movable member reciprocated by said motor, a plurality of operating plates slidably disposed within said movable member, pins located within said movable member and projected therefrom in response to the movement of the corresponding one of said operating plates, a plurality of coin pay-out plates each located to freely engage with the corresponding one of said pins, a plurality of coin holding cylinders for feeding coins therefrom one by one on the corresponding one of said coin pay-out plates, and a controlling mechanism operatively connected to said movable member, whereby when said movable member is moved, said operating plates are also moved selectively one by one through said controlling mechanism, and said pay-out plates are reciprocated by the movement of the respective operating plates thereby paying out the change coins one by one.

2. Apparatus according to claim 1, wherein said controlling mechanism includes a plurality of working rods having lateral projections which engage or release said operating plates to selectively operate one of said operating plates.

3. Apparatus according to claim 1, wherein the upper surface of said pay-out plate is provided with an inwardly inclined portion such that when said pay-out plate is moved backwardly, a coin on the pay-out plate is moved together therewith and engages with the lower end of said coin holding cylinder and falls down therefrom to a coin take-out portion.

4. Apparatus according to claim 1, wherein said controlling mechanism further includes an L-shaped lever, a sliding piece moved reciprocatingly by said lever, and a wheel with predetermined angularly spaced pins, said L-shaped lever being moved by the movement of said movable member and said wheel being rotated by the movement of said L-shaped lever by a predetermined angle.

5. Apparatus according to claim 1, wherein said coin pay-out is provided with a groove and said operating plate is provided with a longitudinal slit, whereby the upper projected end and the lower end of the pin disposed within said movable member are fitted respectively to said groove and said slit in accordance with the engagement of the projections of said working rod with said operating plate.

* * * * *